US007252178B2

(12) United States Patent
Kawahashi et al.

(10) Patent No.: US 7,252,178 B2
(45) Date of Patent: Aug. 7, 2007

(54) ACOUSTIC FLUID MACHINE

(75) Inventors: Masaaki Kawahashi, Saitama (JP); Tamotsu Fujioka, Yokohama (JP); Masayuki Saito, Cincinnati, OH (US)

(73) Assignee: Anest Iwata Corporation, Yokohama-shi, Kanagawa (JP)

( * ) Notice: Subject to any disclaimer, the term of this patent is extended or adjusted under 35 U.S.C. 154(b) by 242 days.

(21) Appl. No.: 10/922,383

(22) Filed: Aug. 19, 2004

(65) Prior Publication Data

US 2006/0037812 A1 Feb. 23, 2006

(51) Int. Cl.
*F01N 1/14* (2006.01)

(52) U.S. Cl. ..... 181/262; 181/250; 181/273; 181/276; 417/57; 417/322; 417/410.1

(58) Field of Classification Search ..... 181/250, 181/262, 273, 276; 417/57, 322, 410.1
See application file for complete search history.

(56) References Cited

U.S. PATENT DOCUMENTS 5,319,938 A 6/1994 Lucas
5,515,684 A * 5/1996 Lucas et al. ..... 62/6
6,638,032 B1 * 10/2003 Vanden Brande et al. .. 417/322
7,086,648 B1 * 8/2006 Steinetz ..... 277/409

FOREIGN PATENT DOCUMENTS

EP 0447 134 A2 9/1991
EP 0 570 177 A2 11/1993
JP 2004-277350 4/2004

* cited by examiner

*Primary Examiner*—Michael Sherry
*Assistant Examiner*—Terrence R. Willoughby
(74) *Attorney, Agent, or Firm*—Davis Bujold & Daniels, P.L.L.C.

(57) ABSTRACT

An acoustic fluid machine such as an air compressor comprises an acoustic resonator, a valve device and a piston. Air is sucked into the resonator through the valve device at one end of the resonator. The piston at the other end of the resonator is reciprocated by an actuator to compress the air in the resonator to cause resonance to increase pressure of the air significantly. The inner surface of the resonator is suitably curved to comply with the formula of a half-period cosine function.

2 Claims, 10 Drawing Sheets

A half-cosine-shaped pipe

Conical pipe

Exponential-function-shaped pipe

A half-cosine-shaped pipe

ACOUSTIC FLUID MACHINE

BACKGROUND OF THE INVENTION

The present invention relates to an acoustic fluid machine based on pressure variation by acoustic resonance and especially to an acoustic fluid machine suitable for use as an air compressor, a cooling compressor and a vacuum pump.

Recently acoustic compressors have attracted considerable attention, the compressors being grounded on pressure variation of large amplitude standing acoustic waves generated by resonance in acoustic resonators.

An acoustic resonator that is important in an acoustic fluid machine such as an acoustic compressor comprises a linear pipe having an internal constant cross-sectional area in EP 0 447 134 A2, and a conical pipe in which an internal cross-sectional area varies in U.S. Pat. No. 5,319,938 A and EP 0 570 177 A2.

When a linear pipe is used as acoustic resonator, waveform becomes steeper owing to nonlinearity with increase in amplitude to generate propagating shock waves in the acoustic resonator. Thus, increase rate of pressure amplitude in the acoustic resonator with respect to amplitude increase in a driving source decreases rapidly to cause acoustic saturation.

When a conical pipe is used as acoustic resonator, shock waves are suppressed, and larger pressure variation amplitude in the acoustic resonator is obtained in proportion to input amplitude increase of the driving source.

However, it is difficult to obtain industrially applicable pressure ratio in the linear or conical pipe, and resonance area is variable with variation in acceleration of the driving sound source depending on temperature change. Specifically, resonance points are likely to be shifted, so that it is difficult to keep resonance points, which results in difficulty in obtaining a stable acoustic compressor.

SUMMARY OF THE INVENTION

In view of the disadvantages in the prior art, it is an object of the present invention to provide an acoustic fluid machine comprising an acoustic resonator to reduce waveform strain and variation in resonant frequency with elevated piston acceleration, thereby achieving stable resonant frequency with respect to driving force amplitude corresponding to operational conditions such as flow rate and pressure as a compressor, to facilitate control in resonance points.

BRIEF DESCRIPTION OF THE DRAWINGS

The above and other features and advantages of the present invention will become more apparent from the following description with respect to embodiments as shown in accompanying drawings wherein.

DETAILED DESCRIPTION OF THE PREFERRED EMBODIMENT

Figure 1A:
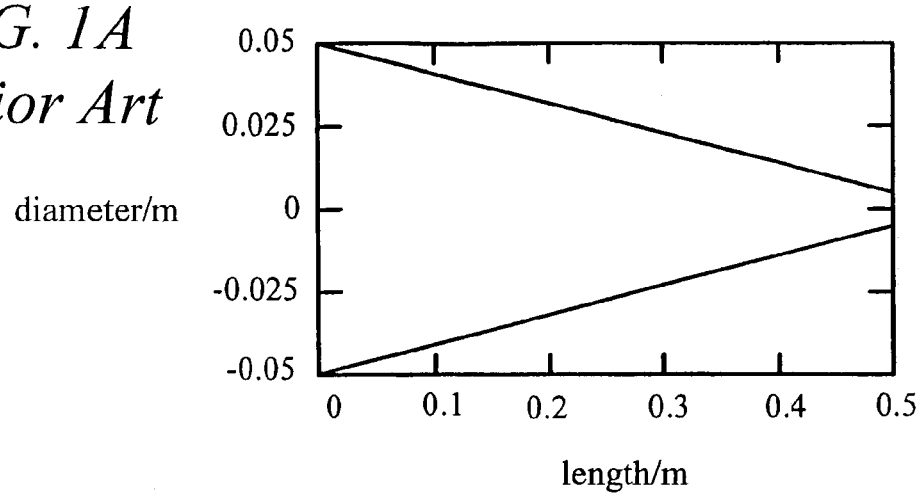
FIG. 1A Prior Art
FIGS. 1(*a*), (*b*) and (*c*) are three graphs which show relationships between length and diameter of acoustic resonators of a conical pipe, an exponential-function-shaped pipe and a half-cosine-shaped pipe respectively.
Figure 1B:
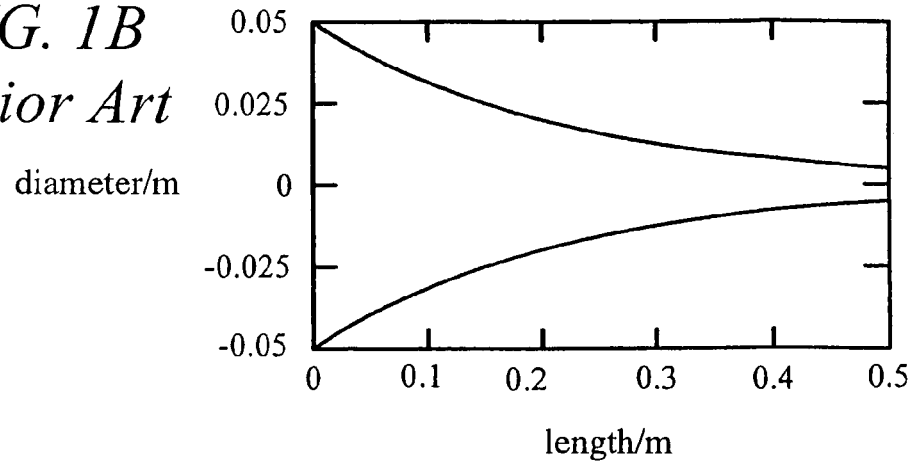
FIG. 1B Prior Art
Figure 1C:
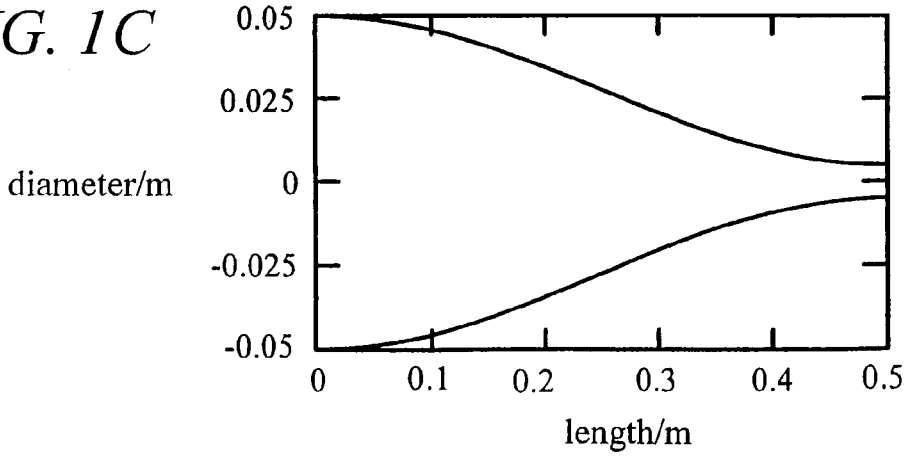

FIG. 1 shows three types of acoustic resonators in which (*a*) and (*b*) are known and (*c*) is the subject of the present invention.

(*a*) A conical pipe: Variation rate in diameter axially is constant.

(*b*) An exponential-function-shaped pipe: Variation rate in diameter at a larger-diameter actuating end is large, while being small at the smaller-diameter suction/discharge end.

(*c*) A half-cosine-shaped pipe in which the inner surface of the acoustic resonator is defined to comply with the formula of a half-period cosine function: Variation rate in diameter is substantially zero at the larger-diameter actuating end and the smaller-diameter suction/discharge end.

Figure 2:
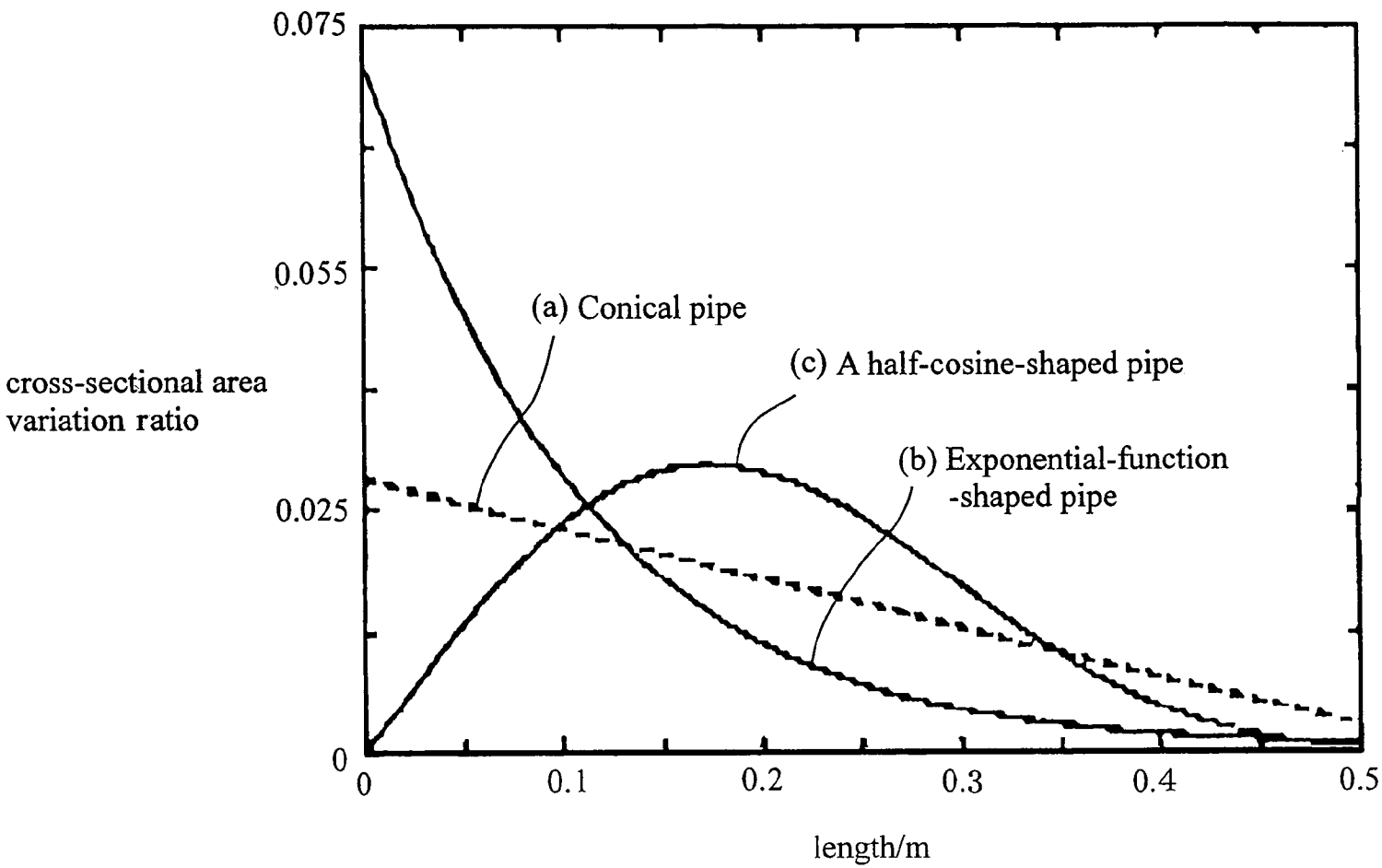
FIG. 2 is a graph which shows relationship between length and cross-sectional area variation rate of the acoustic resonators of FIG. 1.

With respect to the three pipes, variation rate in cross-sectional area in an axial direction is shown in FIG. 2.

FIG. 2 means the following. In the conical pipe, the cross-sectional area reduces linearly in an axial direction. In the exponential-function-shaped pipe, the cross-sectional area reduces steeply and then gradually. In the half-cosine-shaped pipe, variation rate in cross-sectional area is zero at each end, gradually increase from zero and gradually decreases to zero in an axial direction.

Figure 3:
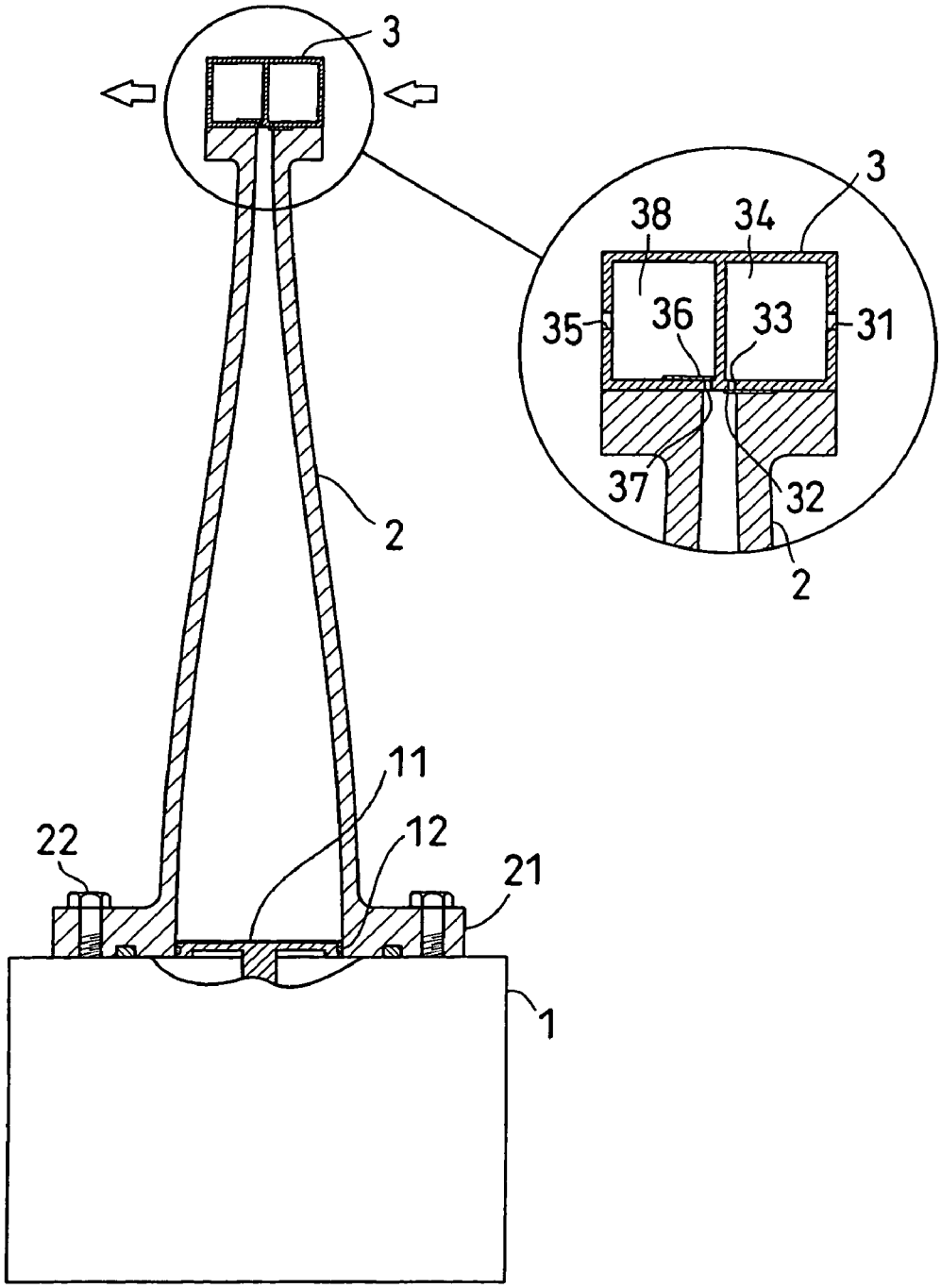
FIG. 3 is a vertical sectional view which schematically shows one embodiment of an acoustic compressor according to the present invention.

An embodiment of an acoustic compressor according to the present invention will be described with respect to a vertical sectional front view in FIG. 3.

The acoustic compressor comprises an actuator 1, an acoustic resonator 2 and a valve device 3.

The internal shape of the acoustic resonator 2 is defined by the following formula:

$$r(x) = \frac{r_p - r_o}{2}\cos\left(\frac{\pi}{L}x\right) + \frac{r_p + r_o}{2}$$

where L is the length of the resonator $R_p$ is the radius of the actuating end of the resonator; and $r_o$ is the radius of the suction/discharge end of the resonator.

The actuator 1 functions also as support and includes a piston 11 movable up and down by a suitable actuating unit (not shown). A sealing member 12 is fitted on the outer circumference of the piston 11.

The acoustic resonator 2 has an outward flange 21 which is put on the upper surface of the actuator 1 and fastened by a bolt 22. The valve device 3 comprises a suction chamber 34 and a discharge chamber 38. The suction chamber 34 has an inlet 31 at the outer side wall and a sucking bore 33 with a check valve 32 at the bottom, and the discharge chamber 38 has an outlet 35 at the outer side wall and a discharge bore 37 with a check valve 36.

The check valves 32,36 comprise reed valves of thin steel plates attached to the lower surface of the bottom of the suction chamber 34 and to the upper surface of the bottom of the discharge chamber 38, or rubber-plate valves.

The piston is made of Al and connected to the actuating unit (not shown) to reciprocate axially at high speed with very small amplitude at the larger-diameter actuating end of the acoustic resonator 2. A driving frequency of the actuating unit is controlled by a function synthesizer and adjusted with accuracy of about 0.1 Hz.

The piston 11 is reciprocated with very small amplitude axially at the larger-diameter end of the resonator 2. When pressure amplitude in the acoustic resonator 2 becomes very small, external air is sucked into the suction chamber 34 through the inlet 31 and sucked into the acoustic resonator 2 through the sucking bore 33 and the check valve 32. When pressure amplitude in the acoustic resonator 2 becomes very large, the pressurized air is passed into the discharge chamber 38 through the discharge bore 37 and the check valve 36 and discharged through the outlet 35.

The results of experiments will be described.

The initial condition provides room temperature of about 15° C. and atmospheric pressure.

Figure 4:
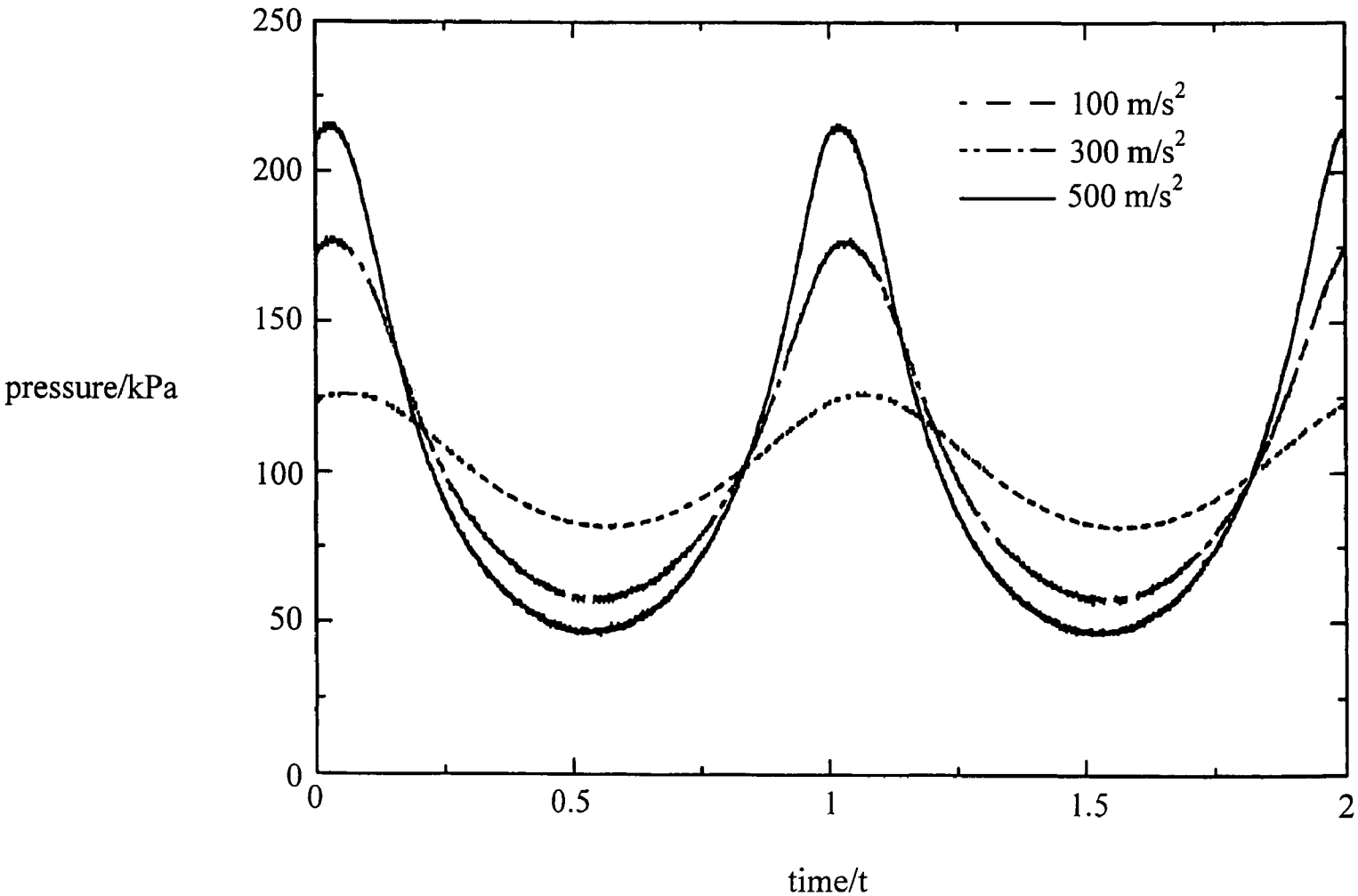
FIG. 4 is a graph which shows relationship between time and pressure at the closed suction/discharge end of the conical pipe.
Figure 5:
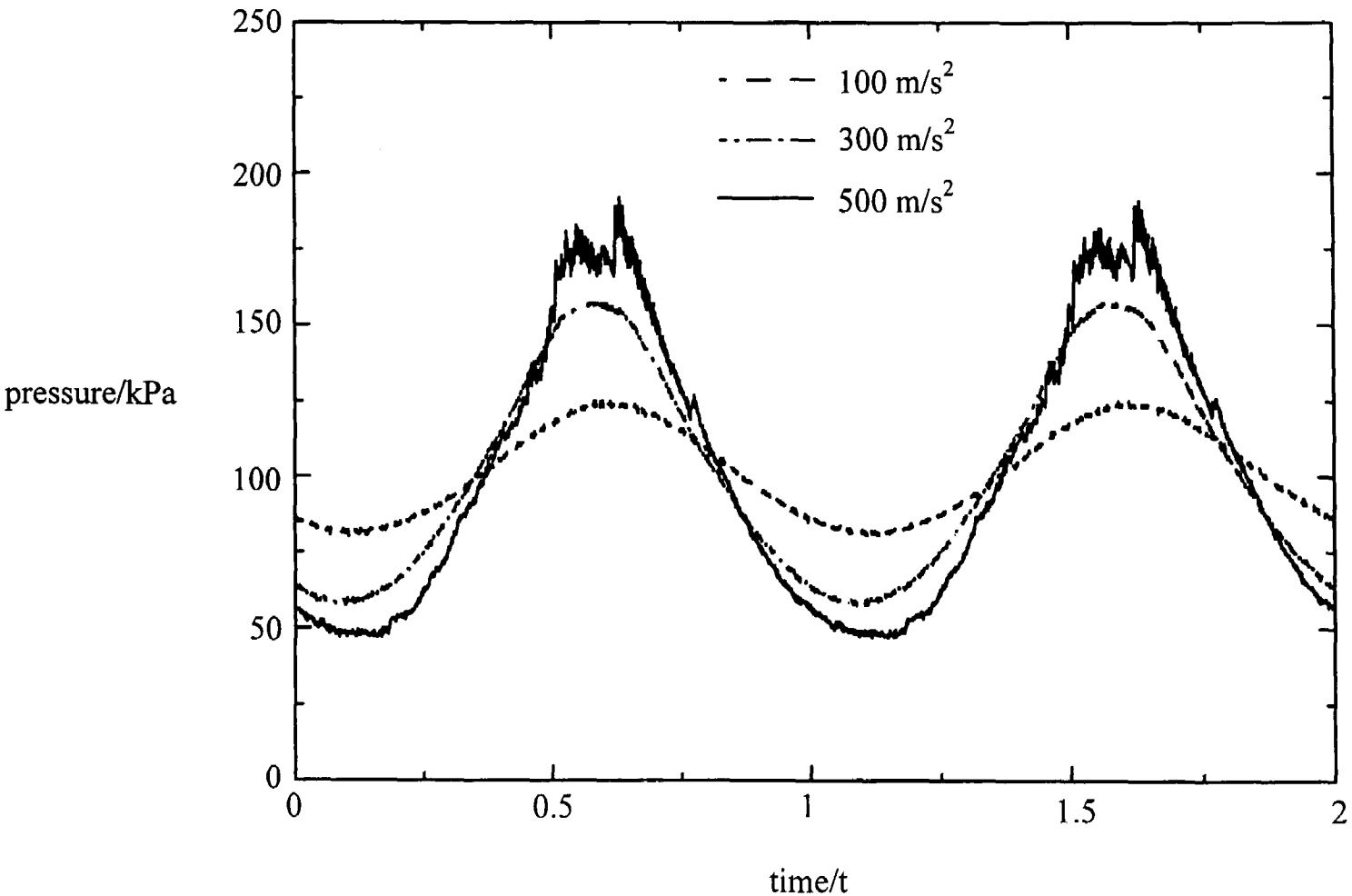
FIG. 5 is a graph which shows relationship between time and pressure at the closed suction/discharge end of the exponential-function-shaped pipe.

FIGS. 4 and 5 show relationship between time and pressure at the closed end of acoustic resonator at piston acceleration of 100 $m/s^2$, 300 $m/s^2$ and 500 $m/s^2$ when the acoustic resonator is a conical pipe and an exponential-function-shaped pipe respectively. Pressure waveform strain significantly reveals as piston acceleration increases. As a result, with respect to initial pressure, positive amplitude becomes unsymmetrical with negative amplitude.

Figure 6:
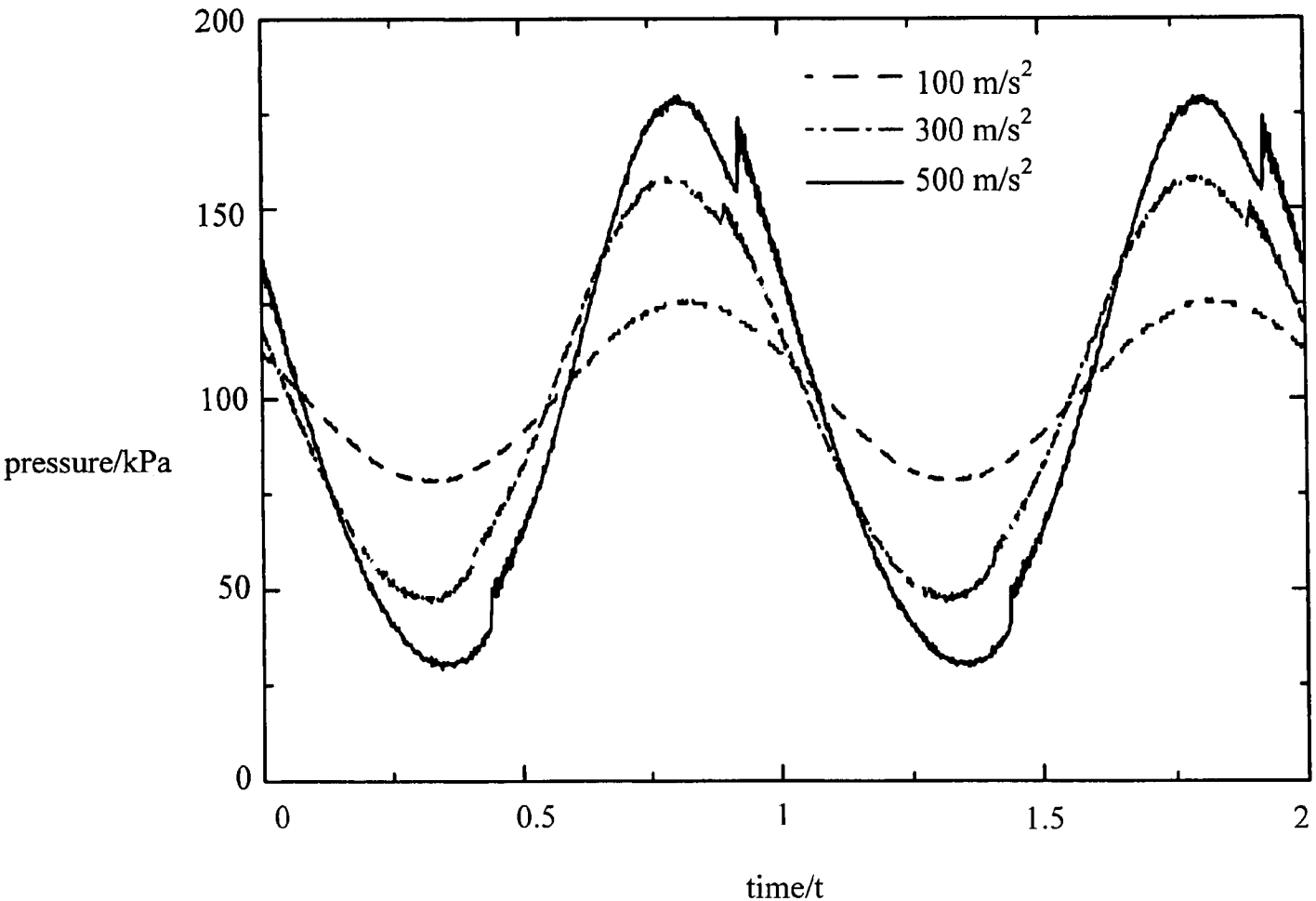
FIG. 6 is a graph which shows relationship between time and pressure at the closed suction/discharge end of the half-cosine-shaped pipe.

In contrast, FIG. 6 shows relationship between time and pressure with respect to a half-cosine-shaped pipe and makes sure that pressure waveform is substantially symmetrical.

Figure 7:
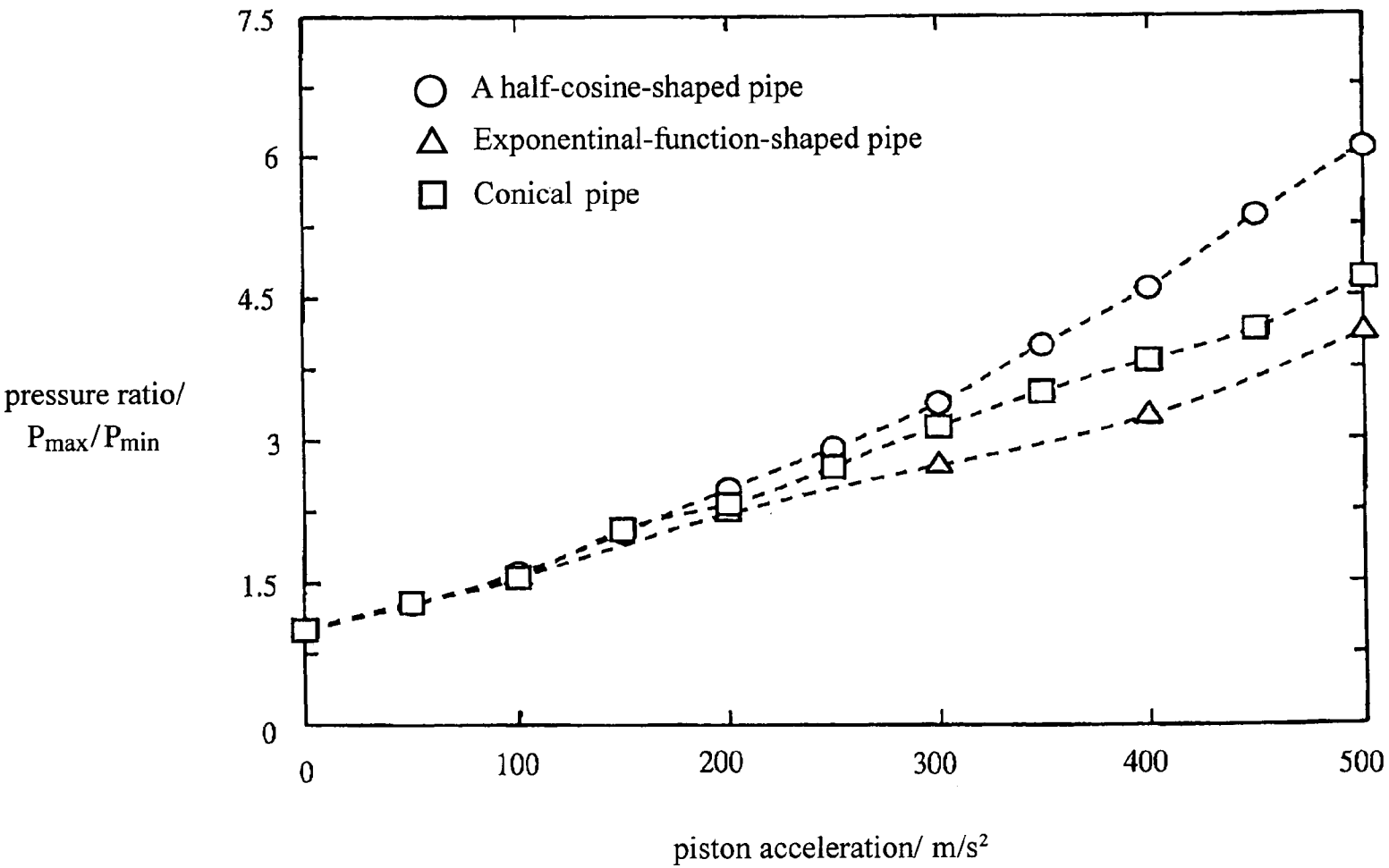
FIG. 7 is a graph which shows relationship between piston acceleration and pressure ratio of the three different pipes.

FIG. 7 shows relationship between piston acceleration and pressure ratio on three different pipes. The pressure ratio becomes the maximum at the half-cosine-shaped pipe in which the minimum pressure is the lowest in the three pipes.

Figure 8:
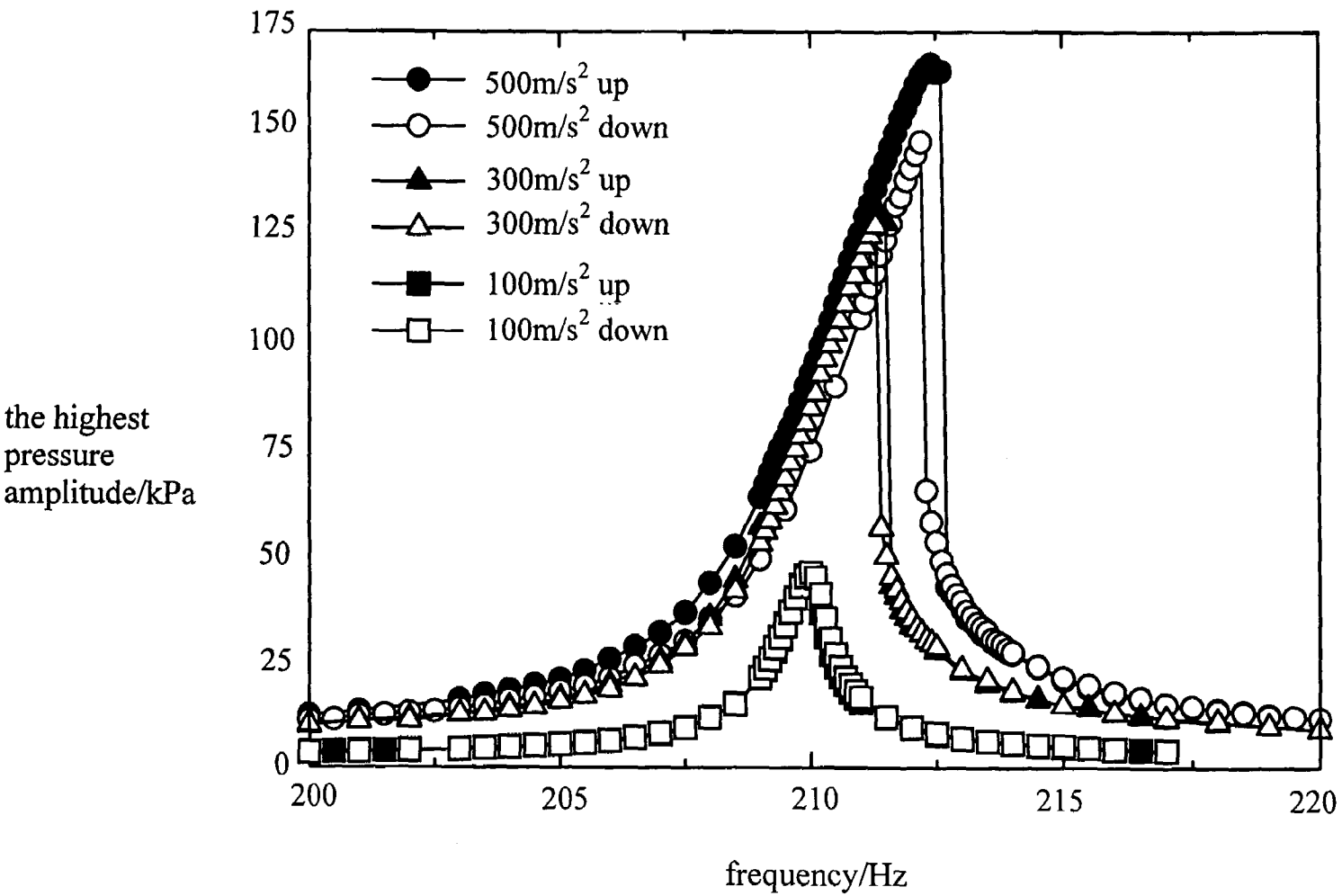
FIG. 8 is a graph which shows relationship between frequency and pressure at different piston accelerations when the acoustic resonator comprises the conical pipe.
Figure 9:
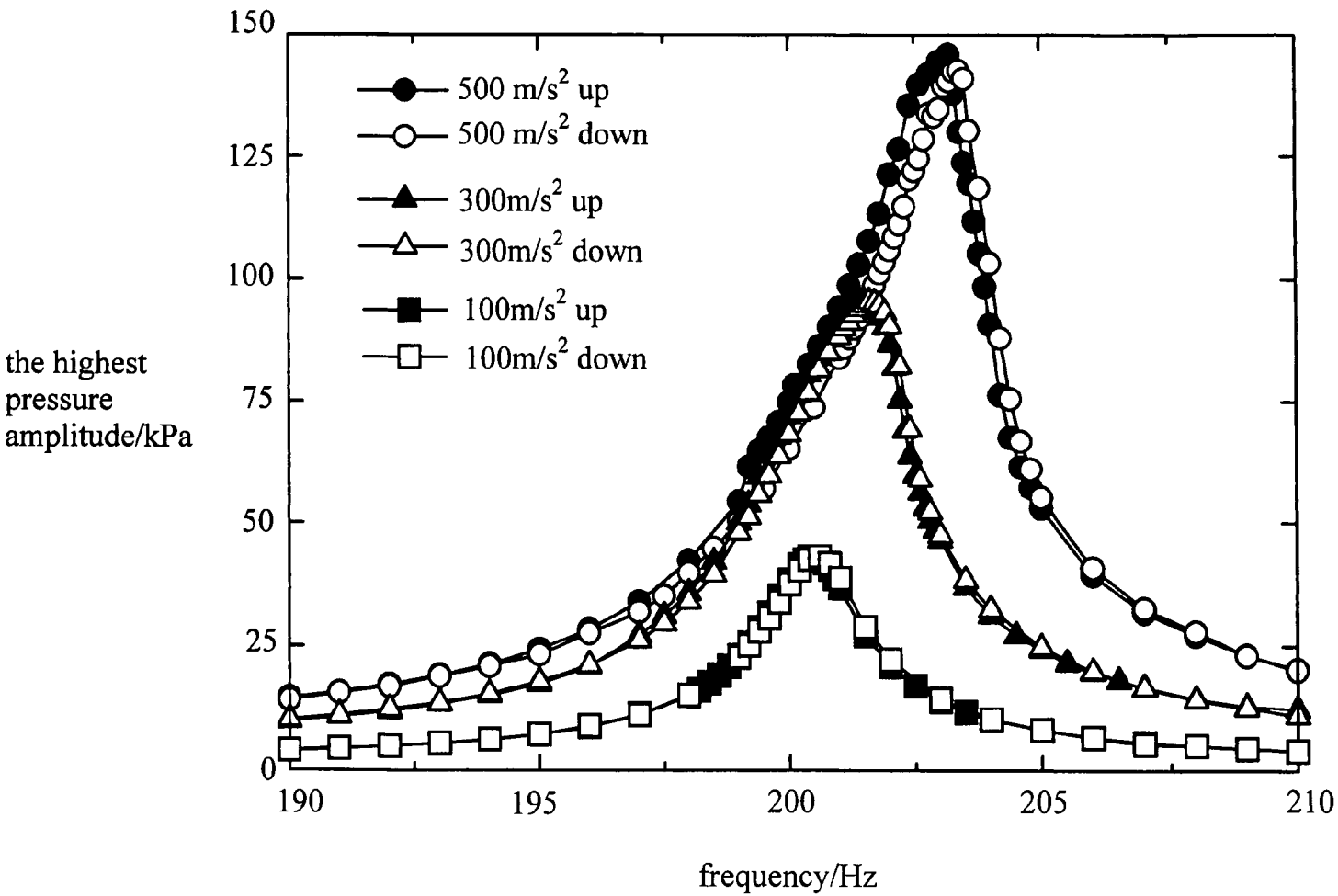
FIG. 9 is a graph which shows relationship between frequency and pressure at different piston accelerations when the acoustic resonator comprises the exponential-function-shaped pipe.
Figure 10:
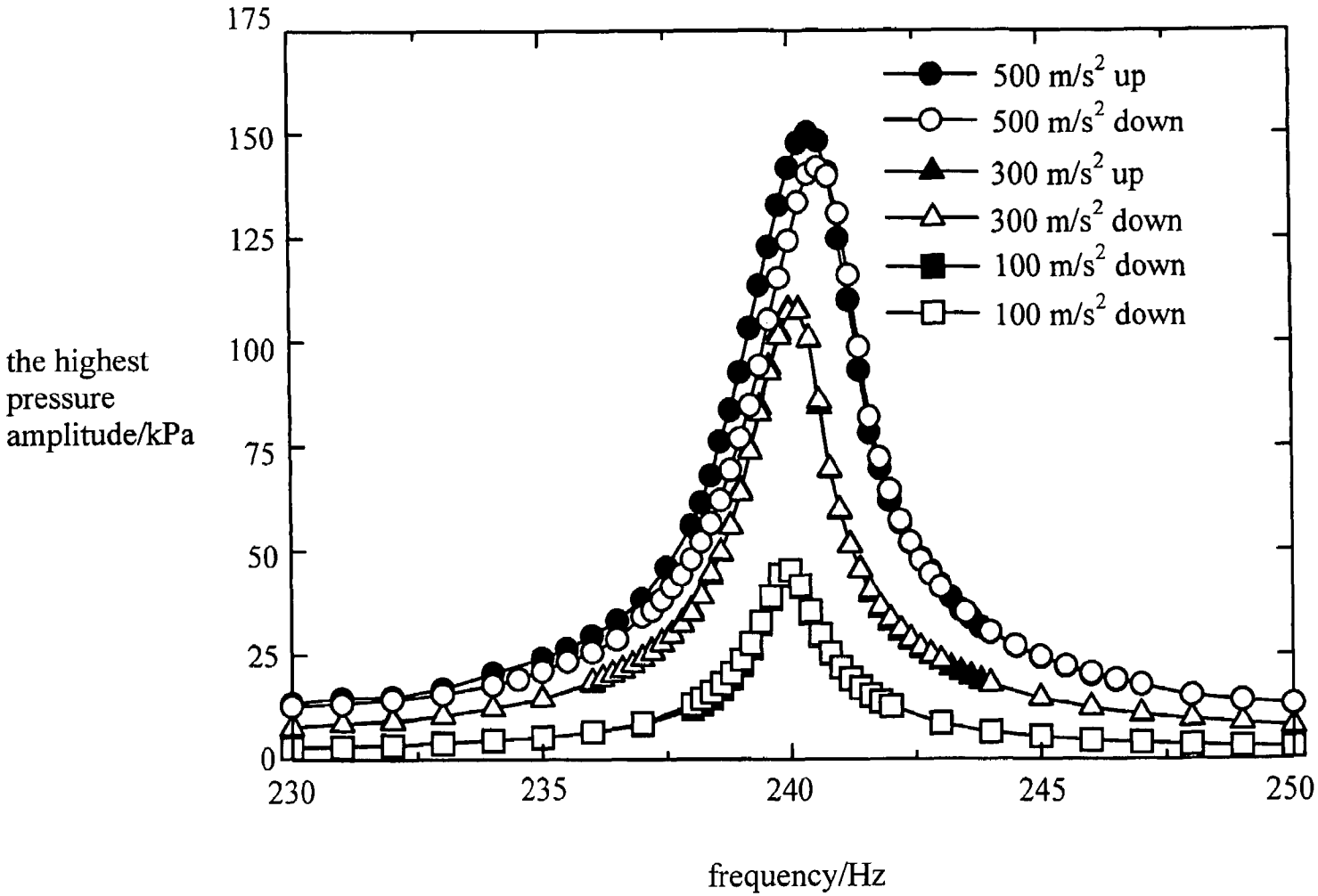
FIG. 10 is a graph which shows relationship between frequency and pressure at different piston accelerations when the acoustic resonator comprises the half-cosine-shaped pipe.

FIGS. 8 to 10 show relationship between frequency and the highest pressure amplitude when the frequency in the vicinity of resonance points varies from the lowest to the highest and vice versa with three kinds of accelerations, 100 $m/s^2$, 300 $m/s^2$ and 500 $m/s^2$. In the conical pipe and the exponential-function-shaped pipe in FIGS. 8 and 9 respectively, with increase in acceleration, the pressure curves are gradually inclined toward the higher frequency region.

So resonant frequency varies with acceleration of the piston, and hysteresis of pressure amplitude variation with respect to frequency variation was observed especially in the conical pipe.

In comparison, in the half-cosine-shaped pipe in FIG. 10, variation in resonant frequency depending on acceleration was not observed and resonant frequency did not vary with increase in acceleration of the piston.

Hence, variation in resonant frequency is small in the half-cosine-shaped pipe to facilitate control on resonance points when it is used as an acoustic compressor.

The foregoing merely relates to embodiments of the invention. Various modifications and changes may be made by a person skilled in the art without departing from the scope of claims wherein:

What is claimed is:

1. An acoustic fluid machine comprising:

an acoustic resonator;

a valve device comprising a suction chamber for sucking fluid from outside and a discharge chamber for discharging the fluid from the acoustic resonator at a first end of the acoustic resonator; and an actuator comprising a piston at a second end of the acoustic resonator, said piston being reciprocated to generate resonance in the acoustic resonator to greatly increase pressure of the fluid, an inner surface of the acoustic resonator being formed by a curve in which variation rate of a cross-sectional area is zero at the first and second ends of the acoustic resonator, said curve gradually increasing and decreasing at substantially the same gradients between the first and second ends, and the curve of the inner surface complying with the formula of a half cosine function of the form:

$$r(x) = \frac{r_p - r_o}{2}\cos\left(\frac{\pi}{L}x\right) + \frac{r_p + r_o}{2}$$

where L is the length of the acoustic resonator; $r_p$ is the radius of the second end of the acoustic resonator; and $r_o$ is the radius of the first end of the acoustic resonator.

2. An acoustic fluid machine for pumping fluid, comprising:

an acoustic resonator, a valve device located at a first end of the acoustic resonator and including a suction chamber for drawing fluid from outside the acoustic resonator and a discharge chamber for discharging the fluid from the acoustic resonator, and an actuator including a piston located at a second end of the acoustic resonator and reciprocated to generate resonance in the acoustic resonator and thereby to cause pressure variations in the acoustic resonator to drive the valve device for pumping the fluid, wherein an inner surface of the acoustic resonator is a curve defined by a half cosine function in which a variation rate of a cross-sectional area of the resonator is zero at the first and second ends of the acoustic resonator and gradually increases at substantially the same gradient from each of the first and the second ends toward an opposite one of the first and the second ends and to a maximum value at a point between the first and second ends, and the half cosine function is of the expression:

$$r(x) = \frac{r_p - r_o}{2}\cos\left(\frac{\pi}{L}x\right) + \frac{r_p + r_o}{2}$$

where L is the length of the acoustic resonator; $r_p$ is the radius of the second end of the acoustic resonator; and $r_o$ is the radius of the first end of the acoustic resonator.

* * * * *